United States Patent [19]

Wood

[11] 4,170,431

[45] Oct. 9, 1979

[54] OFFSHORE PLATFORMS

[76] Inventor: Eric Wood, Cosy Cottage, HaggsHill, Ossett, Yorkshire, England

[21] Appl. No.: 865,379

[22] Filed: Dec. 29, 1977

[51] Int. Cl.[2] ..... E02D 21/00

[52] U.S. Cl. ..... 405/202; 405/195

[58] Field of Search ..... 61/86–95; 52/167; 175/5–9

[56] References Cited

U.S. PATENT DOCUMENTS

| | | | |
|---|---|---|---|
| 2,430,014 | 11/1947 | Hansen | 61/90 |
| 3,208,228 | 9/1965 | Paulet | 61/95 X |
| 3,283,515 | 11/1966 | Pottorf | 52/167 |
| 3,382,629 | 5/1968 | Reutlinger | 52/173 X |
| 3,670,515 | 6/1972 | Lloyd | 61/95 |
| 3,710,580 | 1/1973 | Mott | 61/95 |
| 3,735,597 | 5/1973 | Guy | 61/95 |

*Primary Examiner*—Dennis L. Taylor

*Attorney, Agent, or Firm*—Harrington A. Lackey

[57] ABSTRACT

An offshore platform support structure having a column structure including at least two sections, each section being joined to a vertically adjacent section by a plurality of circumferentially arranged joints defining a plurality of hinge axes lying in a plane substantially normal to the vertical axis of the column structure, to permit yielding tilting about any one of the hinge axis in response to excessive lateral forces exerted against the column structure, and the structure further including damping means arranged to control the rate of return of said sections to the initial position from a relatively tilted position.

5 Claims, 9 Drawing Figures

OFFSHORE PLATFORMS

This invention relates to support structures for offshore platforms, such as drilling platforms, and in particular concerns a support structure for an offshore platform which is suitable for use in relatively deep water, e.g. of 600 ft. or more. The invention also relates to offshore structures embodying a platform and a support structure according to the invention.

With the discovery of oil under the bed of the North Sea, much time has been devoted to the designing of offshore drilling and other platforms and their support structures which are suitable for operation in this particular stretch of water, which is notorious for its widely varying conditions.

One form of offshore structure in use, includes a buoyant substructure held submerged under the water by being tied to the ocean floor by tie ropes, wires or the like. The platform proper is mounted on the substructure on legs so as to lie clear of the surface of the water. This structure has the disadvantage that is can break loose in the event of breakage of the tie ropes and become unstable, and, furthermore, as its stability depends upon a buoyant substructure, its stability will, we feel, be seriously affected due to water currents and wave motions in high seas.

An object of the present invention is to provide an offshore platform support structure which stands in the sea bed, but which is capable of yielding under the action of wave motions to a predetermined extent in order to prevent damage from being imparted thereto in high seas.

According to the invention there is provided an offshore platform support structure comprising a column structure for standing on the sea bed, the structure being in at least two sections which are relatively tiltable from an initial position in a plane or planes which is or are transverse to the column axis by the sections being located one relative to the other by joint means defining circumferentially arranged tilting axes about which the sections are relatively tiltable, the structure further including damping means arranged to control the rate of return of said sections to the initial position from a relatively tilted position. The structure may include yieldable tensioning means urging the sections axially together and resisting said relative tilting.

Preferably, the said joint means comprises circumferentially arranged knuckle type joints.

Preferably also, each pair of circumferentially adjacent joints defines an axis about which the sections are relatively tiltable.

Preferably also, there are three column sections, a lower section, an intermediate section and an upper section, the lower section and intermediate section being located one relative to the other by knuckle type joints, and the intermediate section and upper section being located one relative to the other by knuckle type joints, the tilting axes between the lower and intermediate sections being angularly offset relative to the axes of relative tilting between the intermediate and upper sections.

Preferably, there are three ball and socket type joints defining the knuckle type joints between the lower section and the intermediate section and three similar joints between the intermediate section and upper section.

Alternatively, the joints may be defined by straight ribs lying in straight bar sockets and adapted to knuckle therein as the relative tilting takes place.

When one of the tiltable sections tilts under wave loading, there is stored up energy in the tension cables (where provided) and additionally the wave forces being cyclic, reverse, and act to return the tilted section to the untilted position and as these sections are relatively massive, if the section is accelerated by these returning forces, considerable impact loads can arise, which could cause damage to the section on which the section being returned to the untilted position, stands, were it not for the provision of the damping means.

The damping means may be a plurality of dash-pot type dampers connected between relatively tillable sections, the sea water serving as the damping fluid, but in a particularly suitable arrangement, the damping means are embodied in the apparatus in the region of the said knuckle joints and where each knuckle joint comprises of head and a socket, the damping may be achieved by arranging for the socket to have restriction apertures through which water is forced when the head and socket were back into seating relationship after a relative fitting movement separating the head and socket of each such joint, the head and socket may be capable of limited sliding movement transversely of the structure to facilitate location of each head in to socket after separation as a result of a relative tilling movement.

Preferably the damping means is variable so that the damping effect thereof increases, preferably automatically, the nearer the tiltable section gets to the initial position so that it will sit softly in the initial position and will not go overcentre.

An embodiment of the present invention will now be described by way of example, with reference to the accompanying diagrammatic drawings, wherein.

Figure 2:
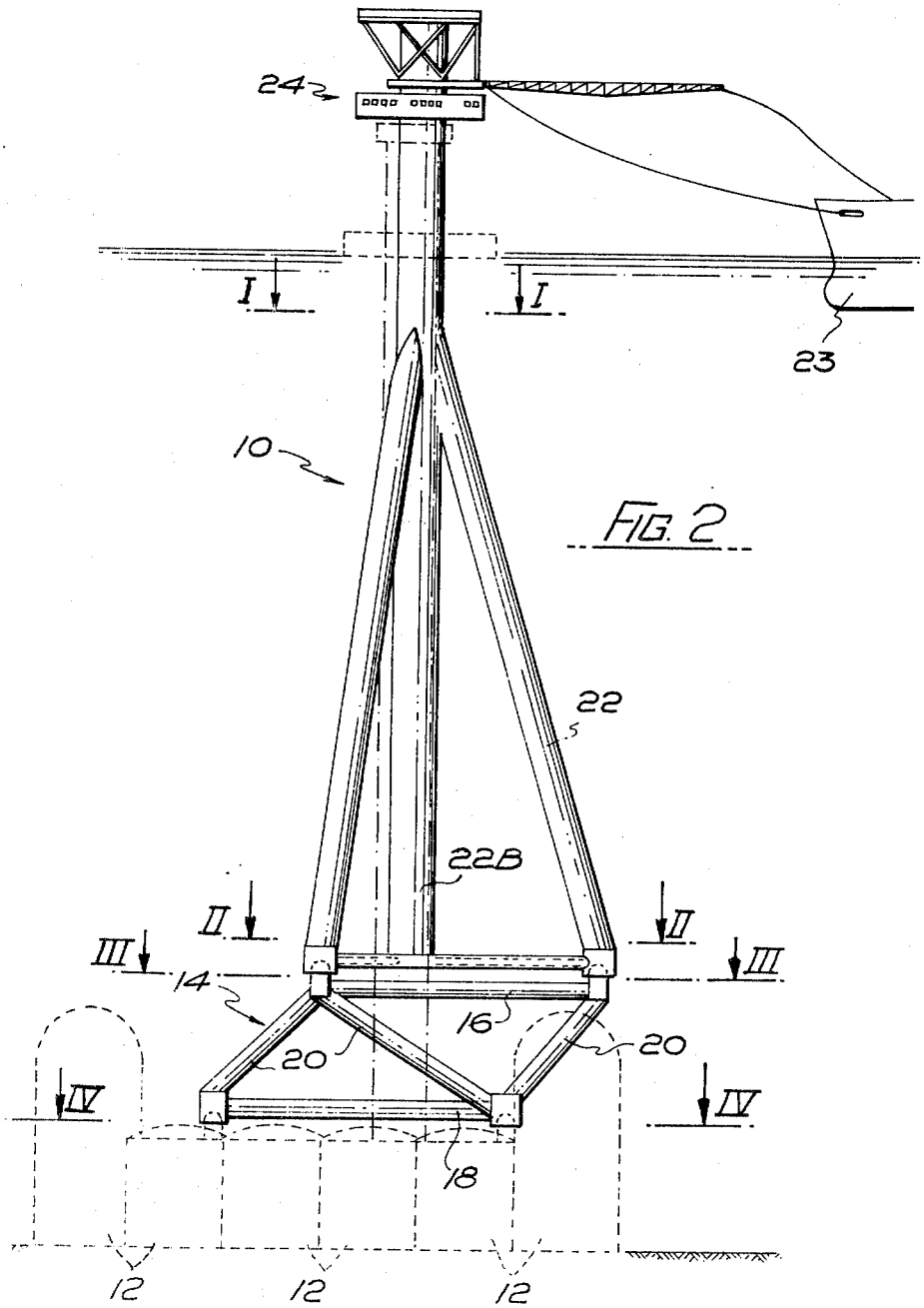
FIG. 2 is a side view of the platform and its supporting structure.
Figure 3:
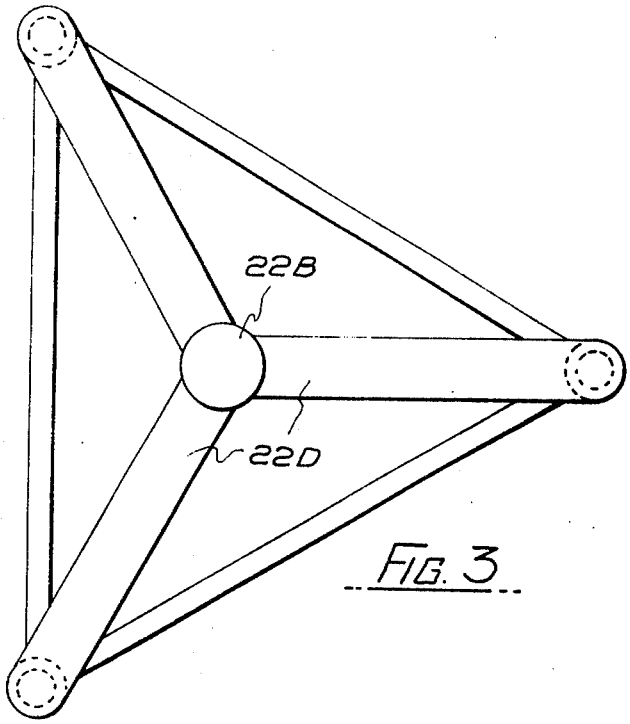
Figure 4:
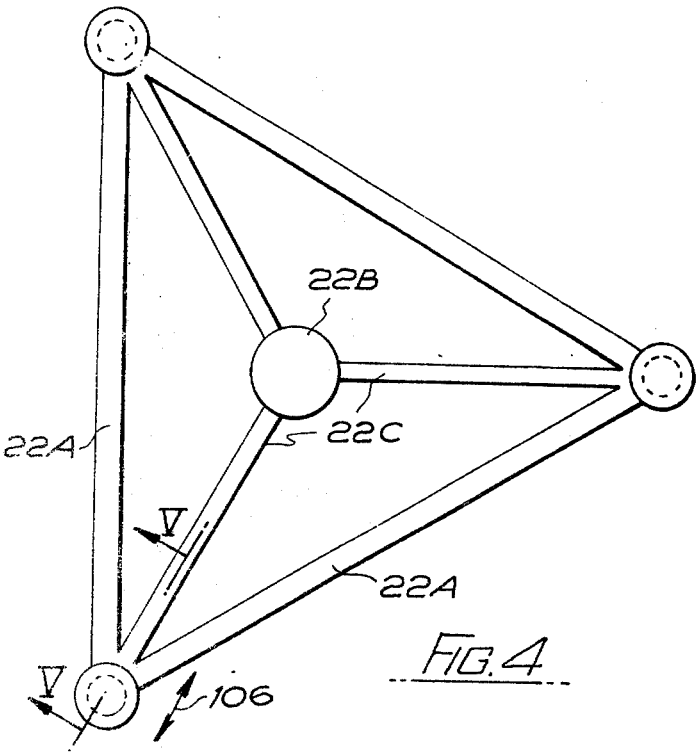
Figure 5:
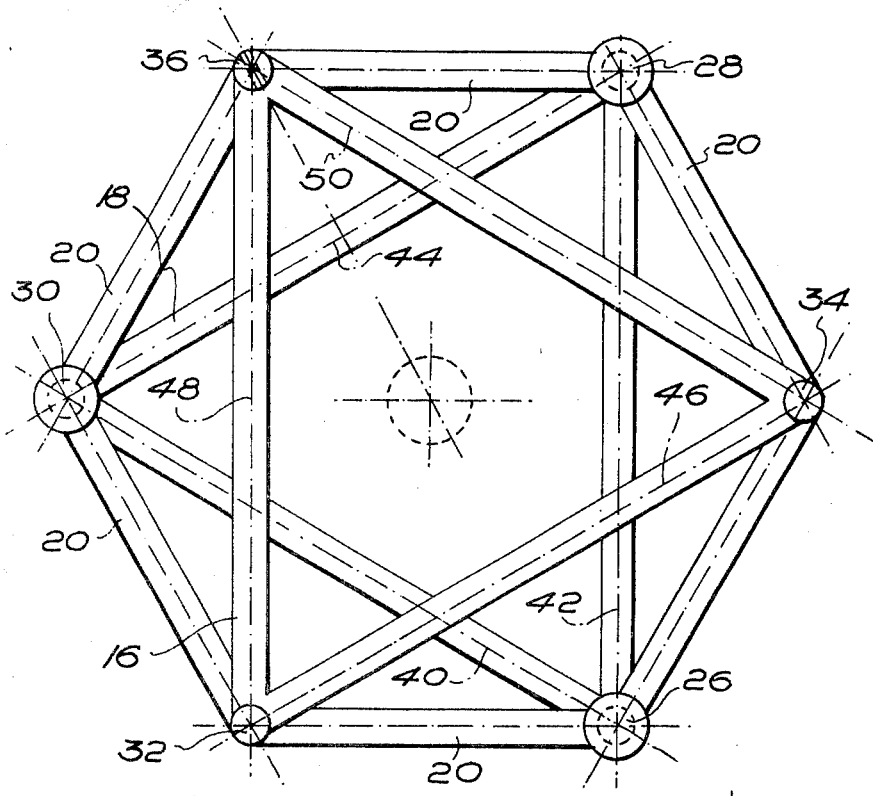
Figure 6:
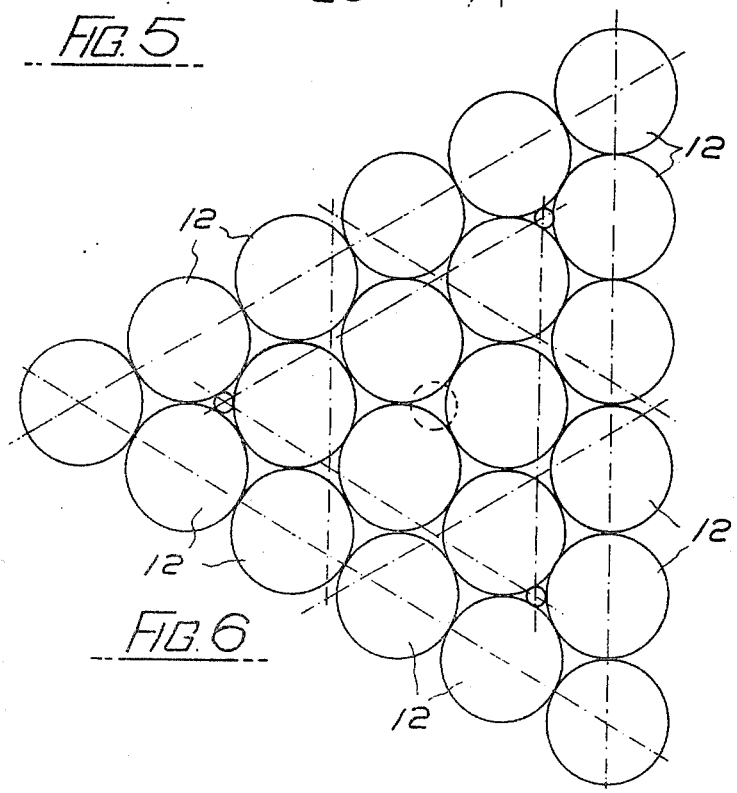
Figure 7:
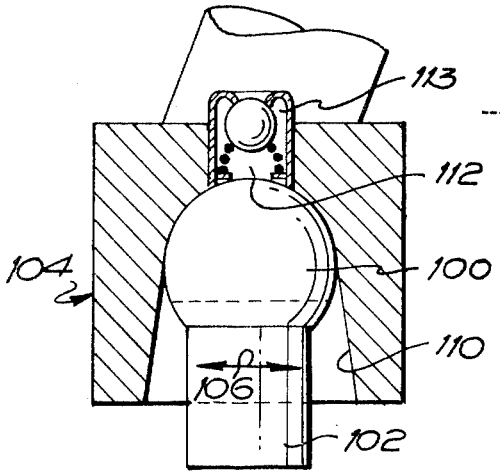
Figure 8:
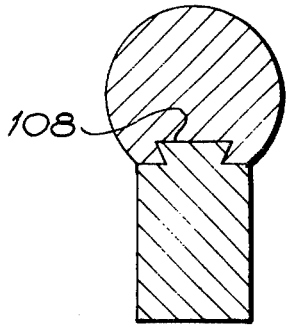
Figure 9:
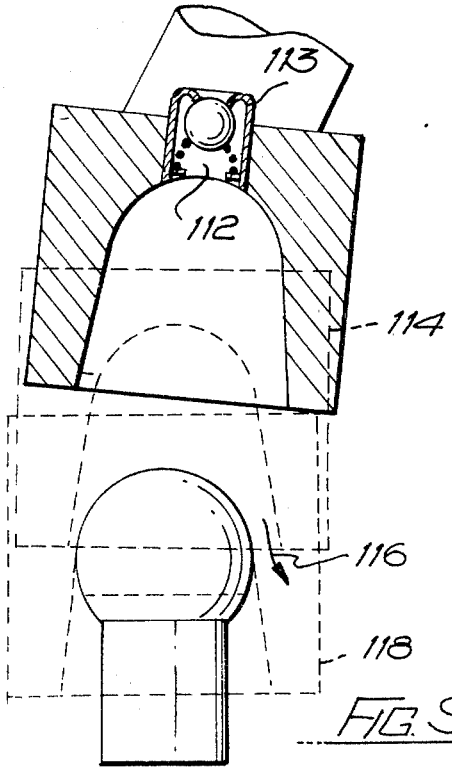

FIGS. 3, 4, 5 and 6 respectively are sectional diagrammatic plan views on the section lines I—I, II—II, III—III and IV—IV respectively as shown in FIG. 2;

FIG. 7 is a sectional diagrammatic side view of the structure at one of the knuckle joints, the section being taken on line V—V of FIG. 4;

FIG. 8 is a sectional side view of the ball and its mounting of the joint shown in FIG. 7 the section being taken on line VI—VI of FIG. 7;

FIG. 9 is a diagrammatic view showing how the ball and socket of the joint shown in FIG. 7 come together after a relative tilting movement of the sections of the structure which separates said ball and socket.

Referring to the drawings, an offshore structure 10 which may be a drilling or service structure or the like includes an upright column when in the in use position. The column essentially is three sections, namely a lower section defined by base storage tanks 12, an intermediate section 14 made up of two heavy triangular frames 16 and 18 which are spaced apart by axially inclined braces 20, and an upper section 22 which is in the form of a triangular frame 22A, a cylindrical central spar 22B, brace rods 22D and support bars 22C. On top of section 22 is a platform structure 24 on which the appropriate derricks, buildings, tanks and the like, as the case requires, will be mounted. The drawings show platforms 24 serving for the filling of a tanker 23 with oil.

Figure 1:
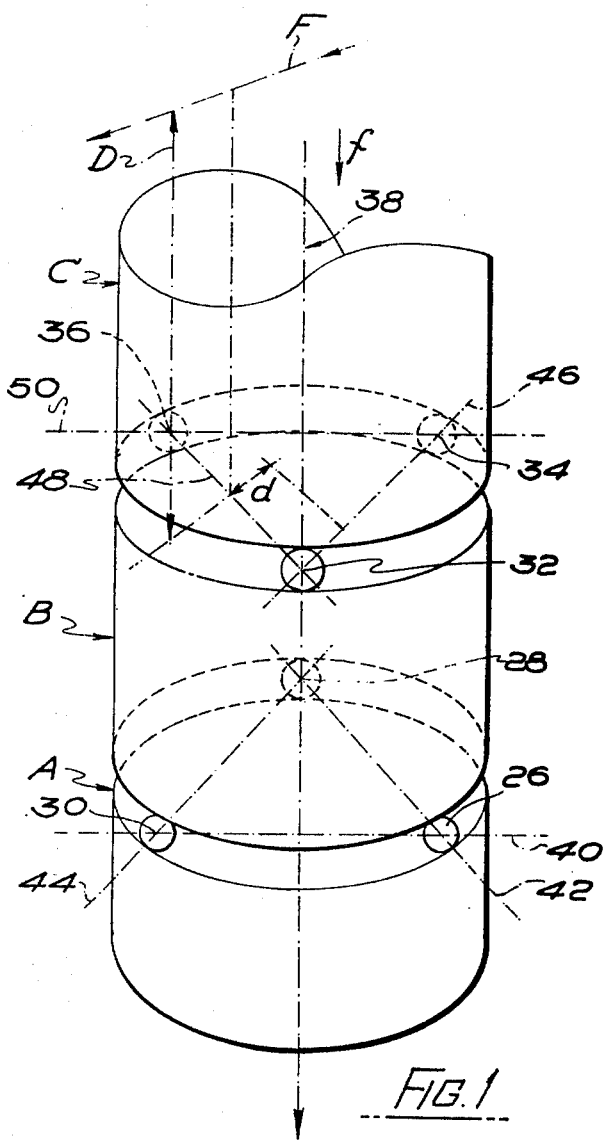
FIG. 1 is a perspective view illustrating the geometry of the platform supporting structure.

The structure is designed so that the upper section of the structure can move if subjected to excessive wave loading thereon, and to this end the lower section and intermediate section are interconnected by knuckle type joints as are the intermediate section and upper section. These joints are in transverse planes, and are designed to enable relative tilting between the sections as will be explained subsequently with reference to FIG. 1. Essentially, each joint is in the form of a ball and socket arrangement and the joints between each pair of adjacent sections are spaced circumferentially of the column. In the example described, the three joints between each pair of adjacent sections are disposed at 120° intervals, and one set of joints in equi-angularly displaced by 60° relative to the other set. This arrangement gives the column freedom of tilting movement in six possible directions as will be explained with reference to FIG. I.

The weight of the intermediate and upper sections keep these sections firmly seated on the knuckle joints, but if required, in addition the sections may be loaded axially together by tensioning means such as heavy duty ropes, wires or the like which are tensioned between the underside of the platform structure 24 and the base tanks 12, the ropes lying outside rod 22B but having their centre of action lying on the centre of the column. These ropes may be of parafil material, so as to be capable of yielding with relative tilting movements of the structure which take place as will now be explained.

Referring now to FIG. I, the lower intermediate and upper sections are represented by references A, B and C and are illustrated in the interests of simplicity to be simply cylindrical structures. The three knuckle joint between sections A and B are indicated by balls referenced 26, 28 and 30. Likewise, the three knuckle joints between Sections B and C are indicated by balls referenced 32, 34 and 36. The central line of action of the gravity force of the sections and if ropes are present, the tension force applied by the ropes, is indicated by reference 38. Each pair of circumferentially adjacent joints in each plane defines an axis passing through the centre of the joints about which the relevant sections are relatively tiltable. Thus, joints 26, 28 and 30 define tilting axes 40, 42 and 50. Joints 26–36 and axes 40–50 are indicated clearly in FIG. 5.

In normal sea conditions, the sections will not tilt relative to one another, but in the event of excessive sea loading being applied to the column, such as indicated by force F in FIG. I, rather than the column suffering damage under this excess loading, it will tilt about one or two of the six axes referred to above, depending upon the direction of the force F. If it is assumed to be in the direction indicated in FIG. I the column will tilt about axis 48 in accordance with the equation.

$$F \times D = (f + w) \times d$$

where f is the force imparted by the tension in the ropes, if provided, and w is the weight acting centrally of the column and resisting the relative tilting movement.

This arrangement ensures that the structure will yield, which is desirable, under excess loading. In practice, because of the dynamics of wave motion, the tilting in a column of the height of 1,100 ft. will be quite small, and because of the cyclic nature of the motion of waves the column will soon move to its static and initial position.

The number of knuckle joints can be varied, as can the number of planes in which knuckle joints are contained and it is desirable that the centre of force applied by the tensioning ropes should be on line 38 centrally of the column and certainly within the plan area contained by all six axes 40 to 50.

The sections of the structure will preferably be fabricated in metal, but they may or at least the intermediate and upper sections may be constructed from reinforced concrete girders joined together to define a framework.

In the event of section 10 or section 14 tilting relatively to the section on which it stands as explained above, the ropes if provided in being tensioned and the mass of the tilted section or sections store up potential energy which tends to return the section or sections to the initial position. Furthermore, the wave forces applied on the section or section causing it or them to tilt are cyclic and in fact reverse and reversal of the forces means that the opposite direction force tends to return the tilted section or sections once more to the initial position. This stored up energy and the reversal of the wave force can in fact accelerate the tilted section back to its initial position with the result that the section when it reaches the initial position can impact heavily on the section on which it stands, and can indeed go over centre resulting in a tilting in the opposite direction with the consequent danger that a resonant situation can be set up with the section tilting back and forward, or the section might rock in a transient manner. In either event, this effect is undesirable because the impacting of the section on the section on which it stands can lead to a destruction of the structure. The present invention provides for the damping of the sections so that after section 10 or I0 and 14 has tilted or have tilted together when the section or sections return to the initial position, its or their return motion is controlled by being damped. The damping can be illustrated achieved by any of several methods. For example, dash pot dampers, using the sea water as the damping fluid, can be connected directly between the sections 10, 12 and 14. It is preferred that the damping means be such that the damping is operative in one direction only, namely in the direction of return of the tilted section or sections to the initial position and that the damping should increase progressively the nearer the section or sections get to the initial position. One way valve arrangements may be used in order to eliminate any damping effect on the sections in tilting away from the initial position. Thus, when section 10 tilts, the appropriate damper or dampers freely draw in sea water, but in the return tilting movement of the section the displacement of the induced sea water is restricted, and in the preferred case is restricted progressively to a greater extent and automatically as the section returns to the initial position, so that the damping is very high when the section reaches the initial position. This arrangement reduces significantly or eliminates entirely the impacting of the section on which the tilting section tilts, and also helps prevent the tilting section from going into a resonant situation.

In a particularly convenient arrangement shown in FIGS. 7 to 9, the dampers are incorporated in the knuckle joints between the sections 10, 12 and 14 and referred to above. As shown in FIG. 7, each knuckle joint comprises a ball member 100 carried by a short pedestal 102, and a socket box 104. The ball member is slidably carried by the pedestal 102 for limited movement as indicated by arrow 106 transversely of the structure by means of a dovetail connection 108, whilst the socket box has a socket cavity 110 for receiving the ball, such cavity being frusto-conical from the bottom, open end up to top region which is part spherical so as to be complementary to the ball 100. A one-way restricted flow passage 112 leads from the part spherical region of the cavity 110 into the leg in which the box 104 is carried for the restricted flow of sea water from the cavity as the ball member 100 and socket box 104 move together to the position shown in FIG. 7. The passage 112 has a one way valve 113 as shown. It is to be noted that the ball member 100 and socket box 104 will be made of wear and corrosion resistant material such as a brass alloy or the like.

The direction 106 of freedom to slide of the ball member 100 relative to its pedestal 10 is also shown in FIG. 4 and it will be noticed that this direction bisects the angle made by the two arms of the frame 22A leading from the joint in question. This means that the ball member slides in a direction which is normal to the axis of tilting defined by the other two knuckle joints, which is the best direction for the ball member 100 to slide in order to take up any misalignment between the ball member 100 and its socket box 104 as they come together after a relative tilting movement of the section which separates the ball member 100 and its socket box and followed by return of the sections to the initial position. It is during such return movement that the movement of the section is damped by the means described.

FIG. 9 illustrates the return movement, the socket box 104 and ball member being shown separated in full lines. As the socket box 104 approaches the ball member 100 as indicated in dotted lines and by numeral 114, member 100 enters the socket cavity 110 trapping a quantity of water therein. Initially, the water can escape past the ball member by virtue of the clearance between the ball member 100 and the frusto-conical region of the cavity 100, as indicated by arrow 116, but this clearance is limited and an initial damping effect is exercised on the return movement of the socket box 104. As the ball member 100 enters the cavity the said clearance is reduced further, and the damping effect progressively is increased until the remaining water escapes through a very narrow clearance, when the damping effect is at a maximum, and eventually the ball member 100 seats on the part spherical portion of the socket cavity 110 as shown in FIG. 7 and in dotted lines and by mumeral 118 in FIG. 9. The return movement is thus damped controlled in order to avoid heavy impacting of the box member 104 on the ball member 100. When the ball 100 and socket 104 are separated, water is drawn into cavity 110 freely through valve 113.

The interior of the leg is open to the free inflow of sea water, and the one-way valve as shown, comprises a ball and a spring urging the ball onto a valve closure seat.

All of the knuckle joints of the structure are similarly constructed, th ball member in each case being arranged to slide in a direction which is normal to the tilting axis defined by the other two knuckle joints in the triangle constituting the plane of tilting.

What the claim is:

1. An offshore platform support structure comprising a column structure for standing on the sea bed, the structure being in three column sections, a lower section, an intermediate section and an upper section, the lower section and intermediate section being located one relative to the other by knuckle type joints so that the intermediate section is relatively tiltable from an initial position relative to the lower section about any of several circumferentially arranged tilting axes lying transverse to the upright platform axis, and the intermediate section and upper section being located one relative to the other by knuckle type joints so that the upper section can tilt relative to the intermediate section in the same manner in which the intermediate section can tilt relative to the lower section, the tilting axes between the lower and intermediate sections being angularly offset relative to the axes of relative tilting between the intermediate and upper sections, and the structure further including damping means arranged to control the rate of return of said sections to the initial position from a relatively tilted position.

2. A structure according to claim 1, wherein there are three ball an socket type joints defining the knuckle type joints between the lower section and the intermediate section and three similar joints between the intermediate section and upper section.

3. A structure according to claim 2, wherein the damping means are embodied in the knuckle type joints in that each knuckle type joint comprises a head and a socket, and the damping means includes restriction apertures in the socket and through which fluid is forced when the head and socket move back into seating relationship after a relative tilting movement separating the head and the socket.

4. A structure according to claim 3, wherein the head or socket is capable of limited relative sliding movement transversely of the structure to facilitate location of each head in its socket after separation as a result of a tilting movement.

5. A structure according to claim 4, wherein each head is mounted for sliding movement in a direction normal relative to the axis of tilting defined by the other two knuckle type joints of the three knuckle type joints between adjacent sections.

* * * * *